US007775813B1

(12) United States Patent
Filiba

(10) Patent No.: US 7,775,813 B1
(45) Date of Patent: Aug. 17, 2010

(54) ELECTRICAL OUTLET WITH LATERAL CONNECTION

(76) Inventor: Yaakov Filiba, 37 Hasarig Street, Rishon Lezion (IL) 75496

( * ) Notice: Subject to any disclaimer, the term of this patent is extended or adjusted under 35 U.S.C. 154(b) by 0 days.

(21) Appl. No.: 12/469,701

(22) Filed: May 21, 2009

(51) Int. Cl.
*H01R 13/44* (2006.01)

(52) U.S. Cl. ..... 439/139

(58) Field of Classification Search ..... 439/139, 439/138

See application file for complete search history.

(56) References Cited

U.S. PATENT DOCUMENTS 4,037,901 A * 7/1977 Kaszuba ..... 439/138
4,520,243 A * 5/1985 McIntyre ..... 200/51.07
5,234,350 A * 8/1993 Marechal et al. ..... 439/139
5,688,132 A * 11/1997 Rogers et al. ..... 439/120
5,902,140 A * 5/1999 Cheung et al. ..... 439/139
6,089,887 A * 7/2000 Ozaki ..... 439/139
6,364,673 B1 * 4/2002 Lee ..... 439/139
6,599,141 B2 * 7/2003 Hambley et al. ..... 439/139
7,331,804 B2 * 2/2008 Okada et al. ..... 439/139
2004/0009689 A1 * 1/2004 Wang ..... 439/139

OTHER PUBLICATIONS

Charlie Sorrel, "Smart Switch Design Incorporates Power-Breaker", Gadget Lab, Wired.com, Nov. 2, 2009.

* cited by examiner

*Primary Examiner*—Gary F. Paumen
(74) *Attorney, Agent, or Firm*—Mark M. Friedman

(57) ABSTRACT

A safety electrical outlet includes a socket body containing at least two electrical contacts, a pivotally mounted socket cap with at least two apertures and a safety mechanism that holds the socket cap in a first position where the apertures are not aligned with the electrical contacts. The socket cap is released when plug prongs are inserted, allowing the socket cap to be rotated so that the prongs can engage the contacts in the second position.

14 Claims, 11 Drawing Sheets

ELECTRICAL OUTLET WITH LATERAL CONNECTION

FIELD AND BACKGROUND OF THE INVENTION

The present invention relates to electrical sockets constructed to receive the prongs of electrical plugs and, more particularly, to a new and improved electrical socket for easier engaging and disengaging electrical connections as well as incorporating a number of safety features relative to use in this position of the socket both for children and adults.

PRIOR ART

Various types of electrical sockets have been devised over the years. The standard electrical socket in homes and offices, for example, incorporates a fixed socket constructed to receive the prongs of an electrical plug in a straightforward manner. The conventional socket has no movable parts; rather, the electrical contacts of a socket are disposed immediately behind the prong holes of the socket. The prongs are held tightly in place due to the tight fit of the prongs in the electrical contacts. Due to this tight fit and the notoriously loose wall socket, the tension that is brought to bear on the plug in order to remove it, often pulls the wall socket out of place as well.

In addition, sockets of this type are a safety hazard for small children. Small children are apt to insert metal objects in one or both of the upper prong holes of the socket. Since, by virtue of the design of the socket, a direct electrical connection will thereby be made, serious injury and even death can result from the child's playful use thereof.

Attempts to overcome the abovementioned hazard have been made, such as providing a rotational plate, which must be rotated in order for the prong to be inserted through aligned prong holes into the U or V-shaped contacts of the socket. But this operation is easily accomplished by a child through the use of hairpins, nails or other metallic objects. Alternatively, arrangements have been devised whereby the entire internal socket needs to be rotationally displaced in order to effect an electrical connection. Such arrangements are cumbersome and complex to manufacture, and yet still lacking essential safety features, such as emergency removal of the plug from the socket using an instinctive 'pulling' movement.

DEFINITIONS

The use of the phrase 'electrical contacts' in this document refers to the live, neutral and ground contacts of an electrical socket, unless otherwise specified as referring to only one or two of the contacts.

SUMMARY OF THE INVENTION

The inventor has conceived and herein discloses a new and useful electrical socket offering a number of advantages over the prior art. The current innovation provides a socket wherein the electrical prongs of an electrical cord plug, even though inserted through the prong holes of a socket, will not make an electrical connection. Contact between plug prongs and electrical contacts can only be accomplished with a rotational movement. Rotational movement can only be accomplished after locking mechanism is disengaged, i.e. by inserting the live and neutral prongs to their full extent into the socket, thereby displacing the locking pins and releasing the locking mechanism. Removal of a plug can be accomplished in two ways. The first and preferred method is by using a rotational movement in the opposite direction, before removing the prongs from the socket. This method has certain advantages over conventional sockets, as will be enumerated below. The second method, to be used in the case of an emergency, is the conventional method of pulling the plug directly out of the socket. In such a case, a return spring will rotate the socket cap back to the initial, safe, position.

There are a number of additional benefits to this manner of creating an electrical connection. With conventional socket assemblies, when depressing a plug into the socket, the prongs make gradual contact with the electrical contacts, often causing a spark at the initial point of contact. The repeated act of connecting and disconnecting electrical plugs from wall sockets leave clear signs of wear and tear, and can eventually cause the socket and/or plug to become damaged and hazardous. The current invention describes a plug and socket assembly whereby the entire prong slots into the contact at one time, providing a safer manner of connection than previously known.

Conventional sockets contain electrical contacts, the length of which are, at most, between a third and a half of the length of the prong. The contacts therefore make contact with at the very most half of the prong, but more commonly, with only a third or less thereof. Additional surface contact between the prong and electrical contact offers a number of safety and performance enhancements. One such enhancement is apparent when using a heavy plug attachment, such as a electronic voltage transformer. Due to the disproportional weight of a conventional transformer, disposed either above or below the prongs, and due in turn to the conventionally small surface area of contact between prongs and electrical contacts, transformers often slip part way out of the socket, being pulled down by the additional weight of the transformer. In the current invention, the entire prong is gripped by the electrical contact, securing the transformer in place. It is clear that a partially attached transformer is a safety hazard. An additional enhancement is evident when considering that the more surface area of the prong that comes into contact with the electrical contacts, the less heat buildup at the point of contact, due to less resistance.

An additional safety mechanism is provided herein, whereby in the case of an emergency, the plug can be removed from the socket in the conventional fashion. The following examples will illustrate the evident safety enhancement herein. The first example is of a case where the plug needs to be removed from the socket in order to quickly cut power to an appliance or tool that is causing damage to person or property. In such a case, especially the former, one acts instinctively to remove the plug by pulling it out of the wall. Were it necessary to rotate the plug in any unconventional manner, in order to remove it from the socket, the plug would either not be removed in a timely manner to prevent initial or further damage, or in some cases, the instinctive pulling action would cause lesser or greater damage the plug and socket assembly. A second, mundane example, is when someone unfamiliar with the safety socket or perhaps in a moment of forgetfulness, when one attempts to remove a plug in the conventional manner, at the very least it will not budge, but in some cases, where considerable force is brought to bear on the plug, the plug and socket assembly will once again be damaged.

An additional safety feature of the current invention is that pursuant to the conventional removal of the plug from the safety socket—as opposed to the correct method of removal i.e. applying torque in the opposite direction than was employed to secure the plug in the socket—the socket cap is returned to its original position by a spring and secured in place by the aforementioned locking mechanism. Had the socket cap remained in the previous position, the electrical contacts would be disposed directly behind the prong holes and thereby accessible, once again, to hazardous use by small children.

An incidental application of the current innovation is the use of the safety socket as a switch. For example, let us presume that a sandwich toaster is connected to a safety socket of the current invention. When not in use, the prongs can be disengaged from the electrical contacts by applying torque and rotationally displacing the socket cap and plug while leaving the plug in the socket. Apply torque in the opposite direction and an electrical connection is formed. This simple torque action works in a similar fashion to an electrical switch.

According to the present invention there is provided an electrical outlet including (a) a socket body containing at least two electrical contacts, (b) a pivotally mounted socket cap with at least two apertures and (c) a safety mechanism that holds the socket cap in the first position where the apertures are not aligned with the electrical contacts and the socket cap is released when plug prongs are inserted, allowing the socket cap to be rotated so that the prongs can engage the contacts in the second position.

Preferably the socket has a biasing element configured to bias the socket cap in the first position. More preferably the biasing element is a compression spring.

Preferably the safety mechanism contains a locking pin that is released on interaction with the plug prongs. Also most preferably the safety mechanism contains a safety barrier that prevents foreign bodies entered through apertures, while in the first position, from touching the contacts. When the prong releases the locking pin that is connected to the safety barrier, the barrier moves aside, exposing the contacts to the prongs.

In one embodiment the socket cap rotates in place. According to another embodiment the socket cap slides laterally between the first and second positions.

BRIEF DESCRIPTION OF THE DRAWINGS

In one preferred embodiment, there is provided a wall socket containing a circular socket cap encompassing the prong holes and capable of being rotationally displaced once a cord plug has been inserted therein. Only the plug and socket cap are rotated. For an electrical connection to be made, it is necessary to insert the live and neutral prongs to their full extent, thereby depressing locking pins, which release the locking mechanism holding the socket cap in place. Thereafter torque is applied to the plug head, for example in a clock-wise direction, rotationally displacing the plug and socket cap between, for instance, 5 and 15 rotational degrees, in order for the prongs to make an electrical connection with the electrical contacts. In this way, the act of creating an electrical connection, as well as disconnecting a plug from a wall socket, is achieved by applying torque as opposed to pressure or tension. Prongs engage the electrical contacts laterally, slotting into the contacts. To remove the plug, torque is applied in the opposite direction excising the prongs from the grip of the electrical contacts. Once free of the contacts, the plug can be withdrawn from the socket without exercising any significant force on the plug or socket.

Various embodiments are herein described, by way of example only, with reference to the accompanying drawings, wherein.

DESCRIPTION OF THE PREFERRED EMBODIMENTS

The principles and operation of a laterally connecting socket according to the present invention may be better understood with reference to the drawings and the accompanying description.

Figure 1:
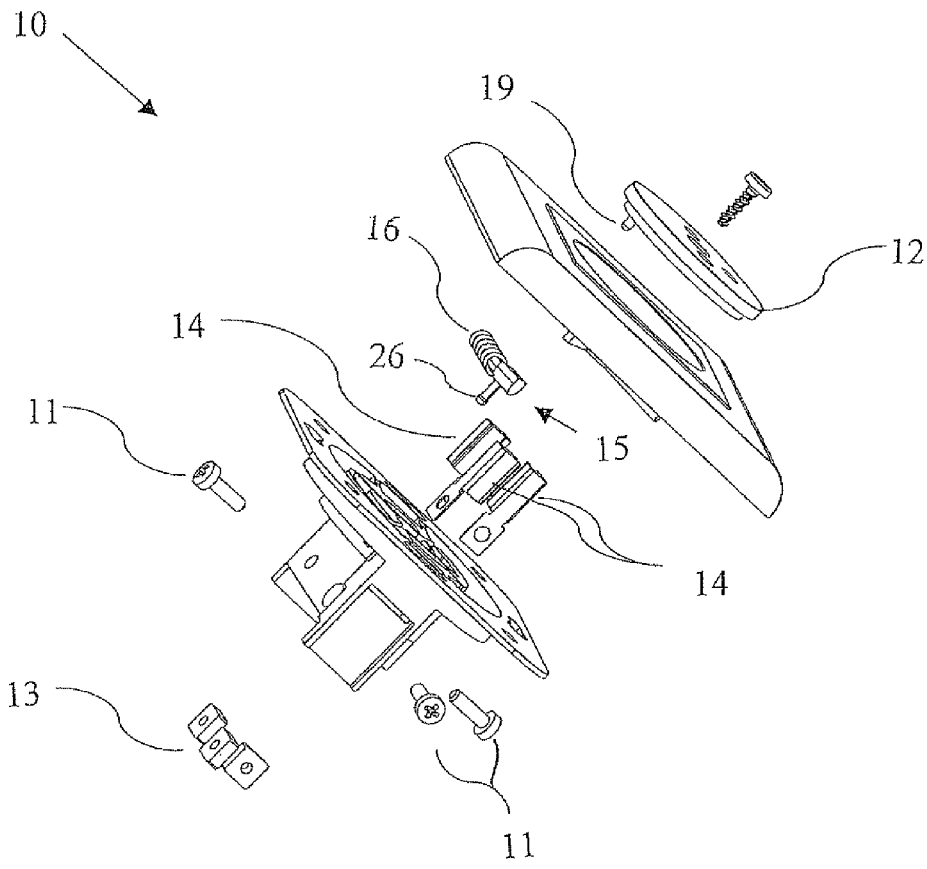
FIG. 1 is an isometric exploded view of an embodiment of an exemplary electrical wall socket.

Referring now to the drawings, FIG. 1 is an exploded isometric view of the preferred embodiment of a safety socket 10. 3 electrical contacts 14 are visible. Each electrical contact is secured in place by a screw 11 and a nut 13. The electrical contacts work in a similar fashion to conventional electrical contacts. A return spring assembly 15 containing a spring 16 and a spring guide 26 are coupled to a socket cap 12 via a flange 19. The socket cap contains three socket apertures 20 through which electrical plug prongs are inserted.

Figure 2:
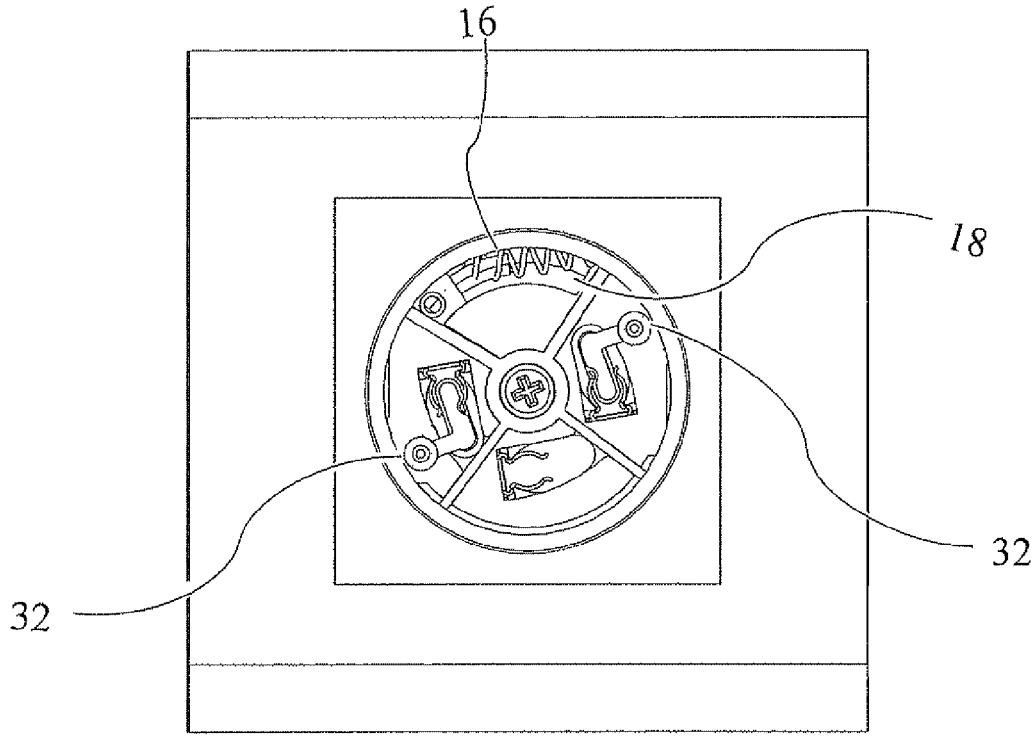
FIG. 2 is a frontal view of the socket with the socket cap removed.
Figure 3:
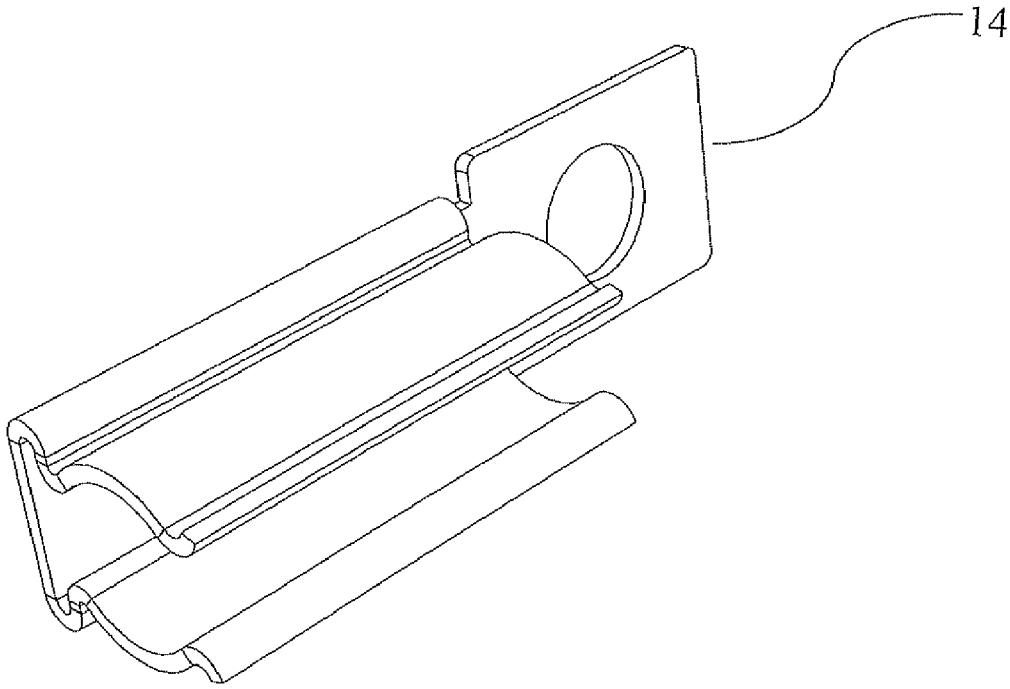
FIG. 3 is an electrical contact.
Figure 4:
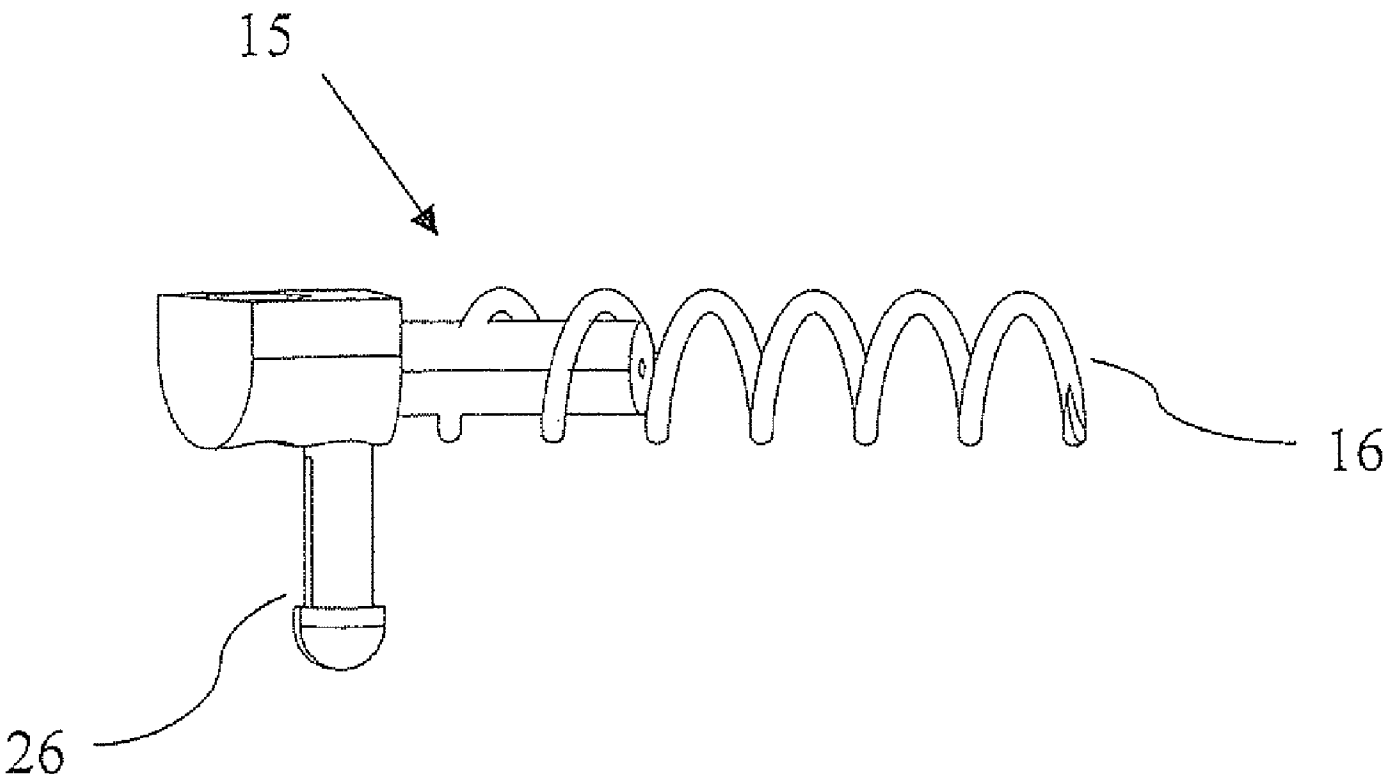
FIG. 4 is a return spring and guide.
Figure 5:
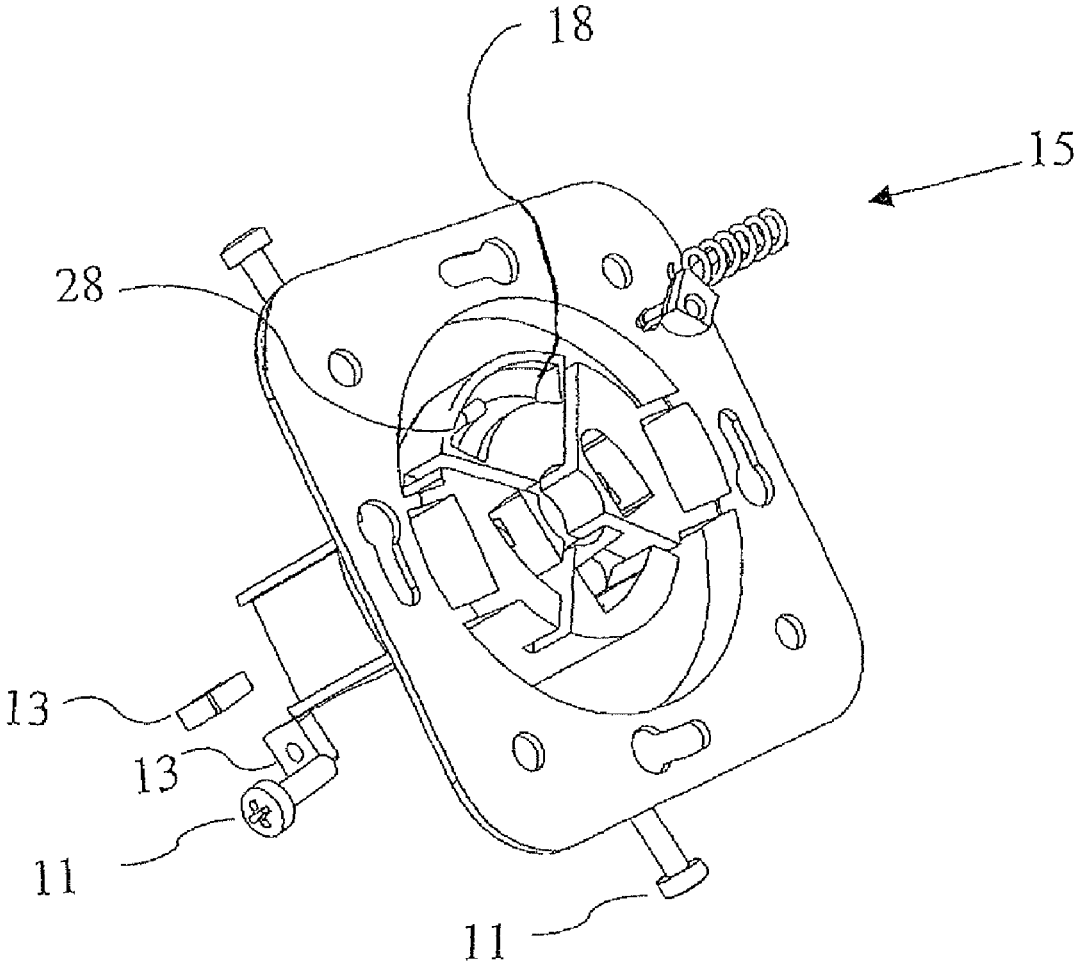
FIG. 5 is an exploded view of the socket body and return spring only.

FIG. 2 shows a frontal view of the socket with socket cap 12 removed. Spring 16 is positioned within a spring channel 18. When an electrical plug (not shown) is inserted through socket holes 20, the prongs (not shown) come to rest in respective socket cavities 22, where they do not touch the electrical contacts. A locking pin 32 protrudes from the socket wall of the socket cavity of the live contact, and is disposed directly behind the socket hole when the socket cap is in the initial position. The locking pin is in the form of the letter "J", where the shorter leg protrudes from the socket cavity and the longer leg extends into a crevice in the socket cap, preventing the socket cap from rotating. A similar locking pin is located in the cavity of the neutral contact. Depressing both locking pins 32 simultaneously releases the locking mechanism that otherwise prevents the socket cap from being rotated. At this stage, torque is applied to the plug body in a clockwise direction, rotating the plug and socket cap. As the socket cap is rotated, spring 16 is compressed. Prongs engage contacts 14 laterally, slotting into the contacts. To disengage the prongs from the contacts, torque is applied in the opposite direction, excising the prongs from the grip of the contacts. Once free of the contacts, the prongs can be withdrawn with minimal exertion. Additionally, an electrical plug can be removed in the conventional manner, by pulling the plug directly out of the socket. In the latter case, spring 16 will expand along a spring channel 18, in which it is disposed, pushing guide 26 and socket cap 12 back to the initial position. Once the socket cap is returned to the initial position, the locking mechanism reengages. Spring 16 and guide 26 are shown in FIG. 4. Spring channel 18 and guide channel 28 are shown in FIG. 5. FIG. 3 is an enlarged view of an electrical contact 14. The electrical contacts of the current invention are slightly longer than the conventional contacts and are intended to grip a large portion of a plug prong. This affords a firmer than usual grip on the prong as well providing less resistance to the electrical current. The depicted contact is fashioned to receive 4 mm round prongs.

Figure 6:
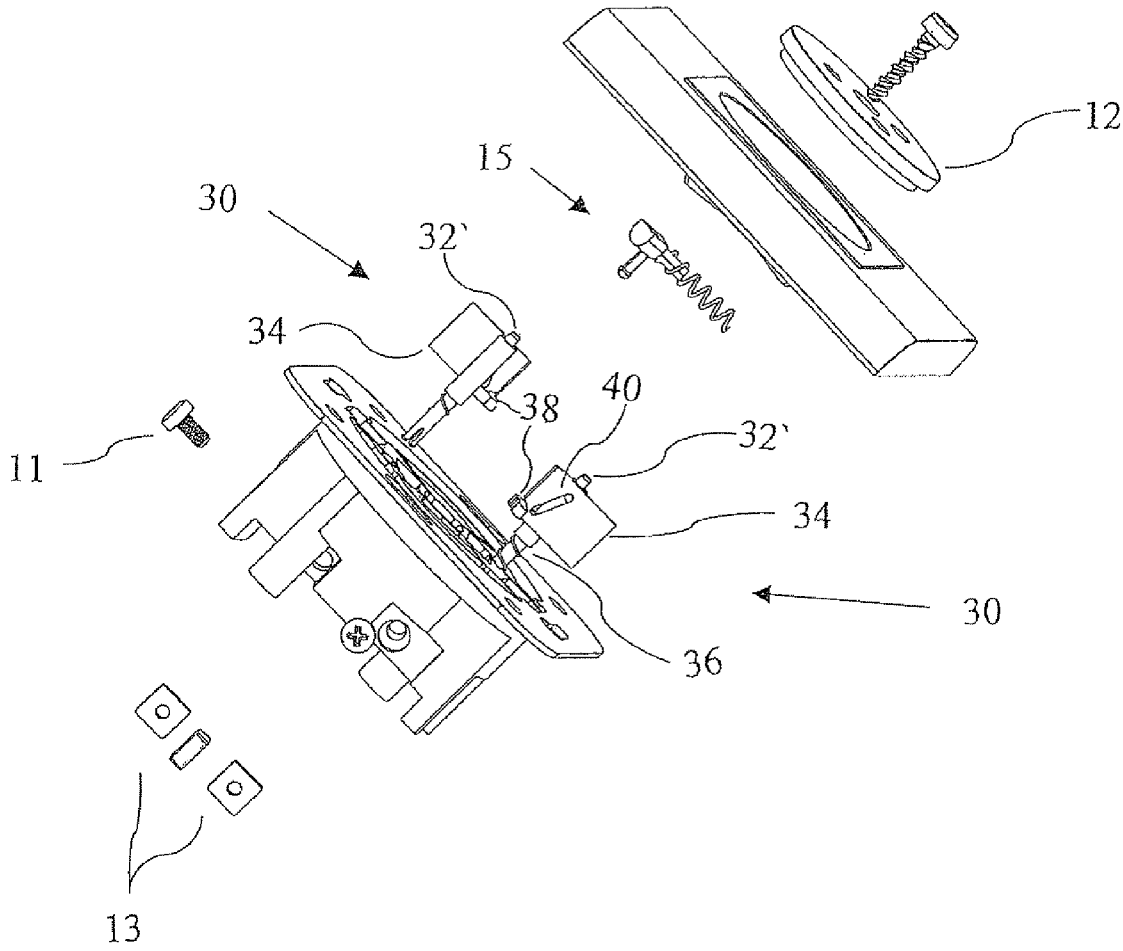
FIG. 6 is an isometric exploded view of a variant of the socket of FIG. 1 with safety barriers and where electrical contacts have been removed.

FIG. 6 is an isometric exploded view of a variant of the socket of FIG. 1, wherein a barrier locking mechanism 30 is displayed. Barrier locking mechanism 30 includes a locking pin 32', a safety barrier 34, a locking spring 36 and a flange 38. The lower part of locking pin 32' is encircled by the locking spring. There is a tab (not shown) on locking pin 32' that fits into a diagonal slot 40 in safety barrier 34. Safety barrier 34 is operationally coupled to locking pin 32' by flange 38. The barrier is interposed between the point of entry of a plug prong and the electrical contact. When the locking pin 32' is depressed (under mechanical pressure from a plug prong), the tab 40 forces the barrier to slide laterally, thereby opening the blocked cavity to allow the plug prong to engage the electrical contact. The locking mechanism provides a number of safety features to the socket. Firstly, when engaged, the locking pin prevents the socket cap from rotating (as mentioned above). Secondly, when in place, the barrier prevents an object entered through the prong holes from accidentally touching the electrical contact. With the removal of the plug prong, locking spring 36 expands returning locking pin 32' and barrier 34 to their initial, locked, position.

Figure 7:
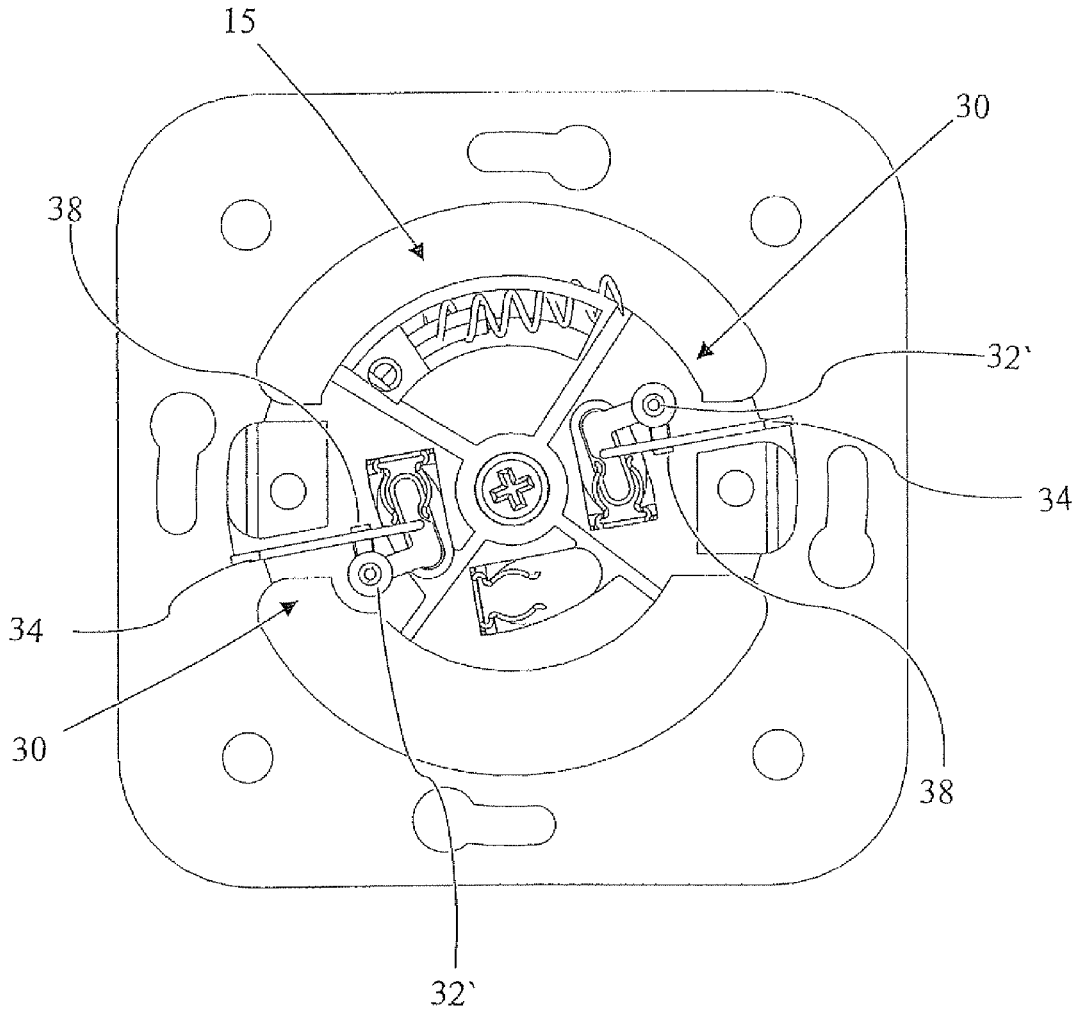
FIG. 7 is a frontal view of the exemplary wall socket with safety barriers where the socket cap and socket cover have been removed.
Figure 8:
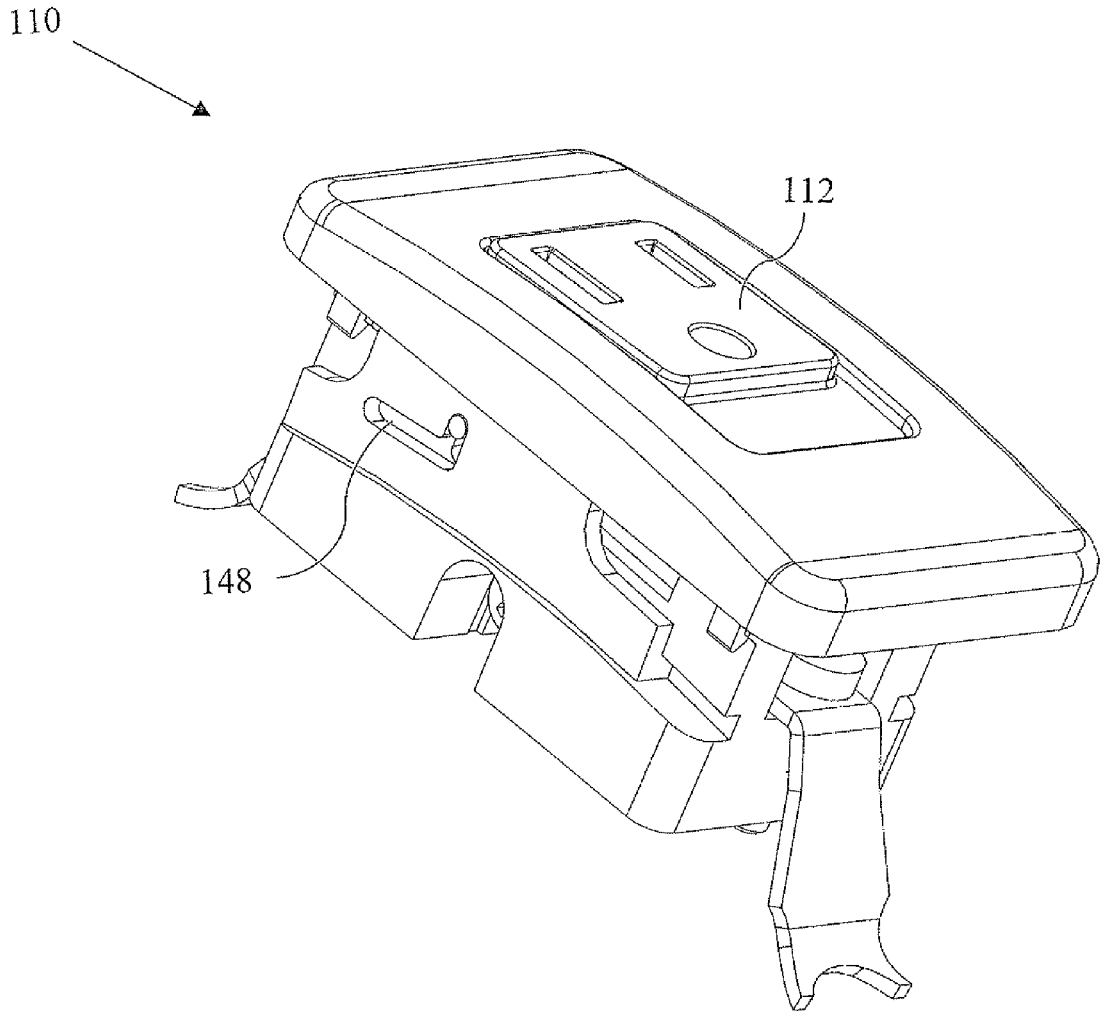
FIG. 8 is an isometric bottom view of a second embodiment of the current invention.

FIG. 7 is a frontal view of the second embodiment of the invention with the socket cap and socket cover removed. Safety barriers 34 are clearly viewed in place preventing potential access of a foreign body, entered through the apertures in the socket cap, to the electrical contacts Another possible configuration is shown in FIG. 8. In this configuration, the socket cap 112 is displaced laterally (FIGS. 10-13) as opposed to the in-place rotational movement employed in the previous configuration.

FIG. 8 shows a socket 110 wherein the socket face is concave and wherein rightward movement (as drawn) causes the socket cap to slide over the socket face in a circular motion traversing from 5 to 25 rotational degrees. The current configuration is adapted to receive at least NEMA 1-15, NEMA 5-15, NEMA 5-20 and JIS C 8303, Class I and Class II plugs which all have the basic structure of at least two parallel blades and in the case of NEMA 5-15 and NEMA 5-20, a round or U shaped earthing prong. In order to ensure grounding before the power is connected, the ground electrical contact is slightly heightened so that the ground prong will come into contact with the ground contact before the blades come into contact with the electrical contacts. Conventional electrical contacts for the abovementioned plugs are fitted in the socket of the current configuration. An "L" shaped locking channel 148 is visible on the side of the socket. A similar locking channel exists on the other side of the socket.

Figure 9:
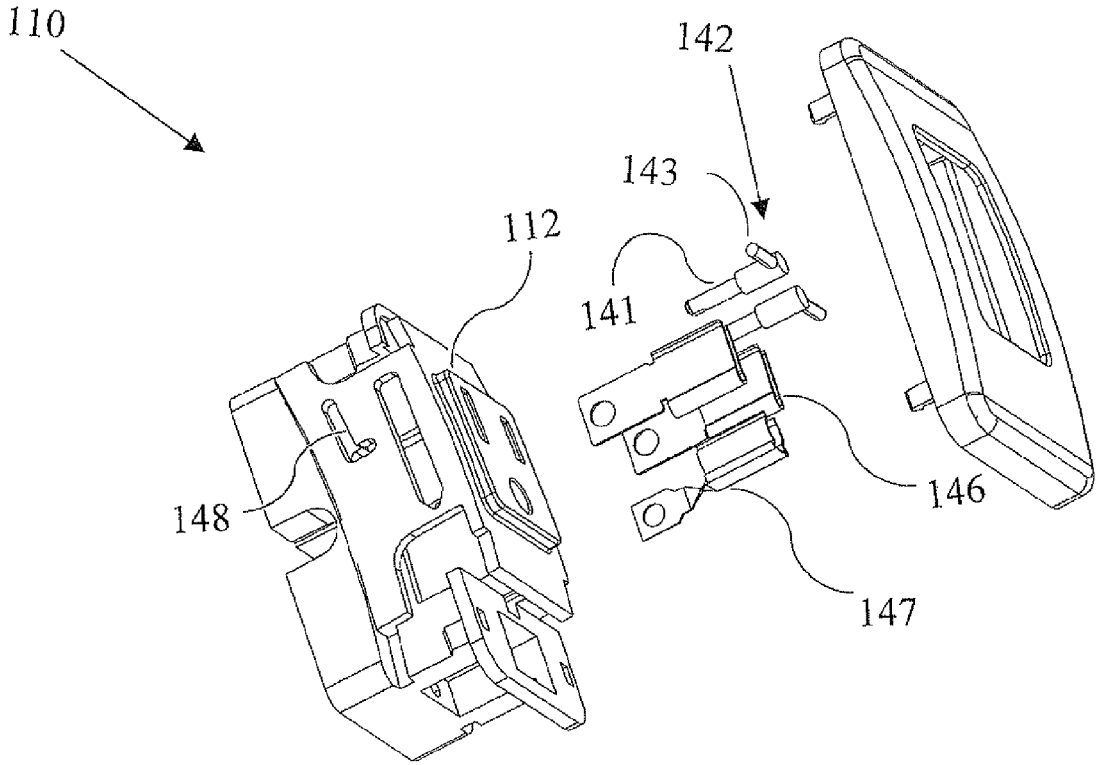
FIG. 9 is an exploded isometric view of a second configuration of the current invention.
Figure 11:
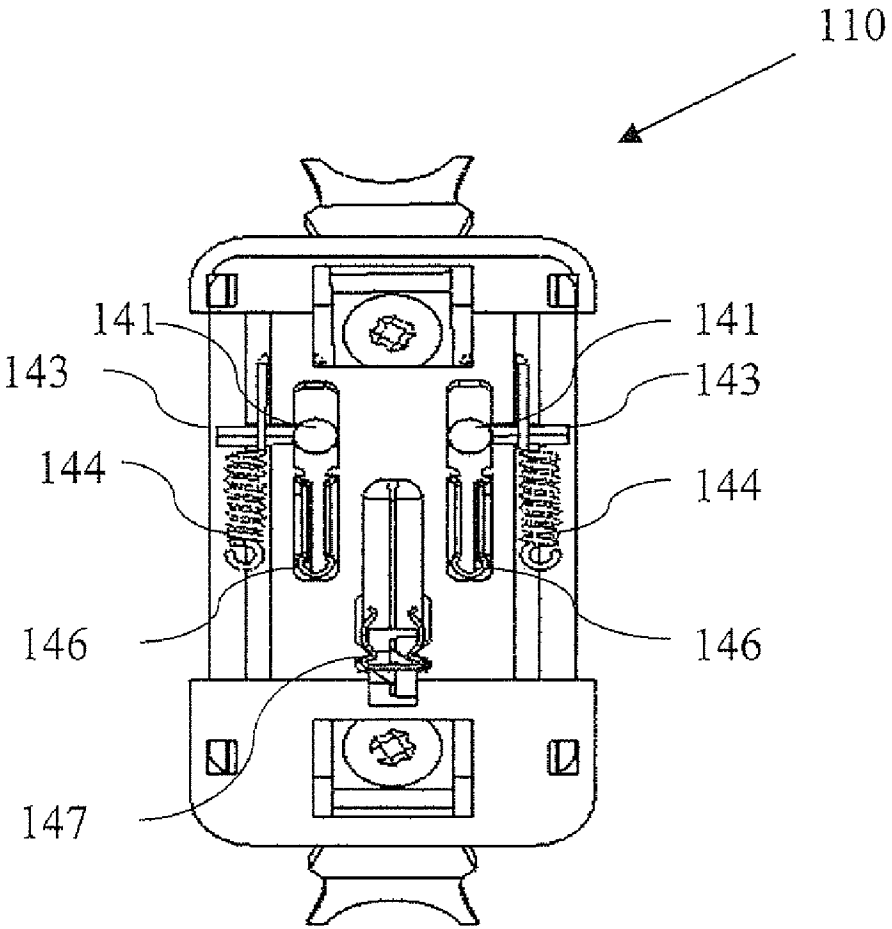
FIG. 11 is a frontal view of the second configuration of the current invention with socket cap and socket cover removed.
Figure 10:
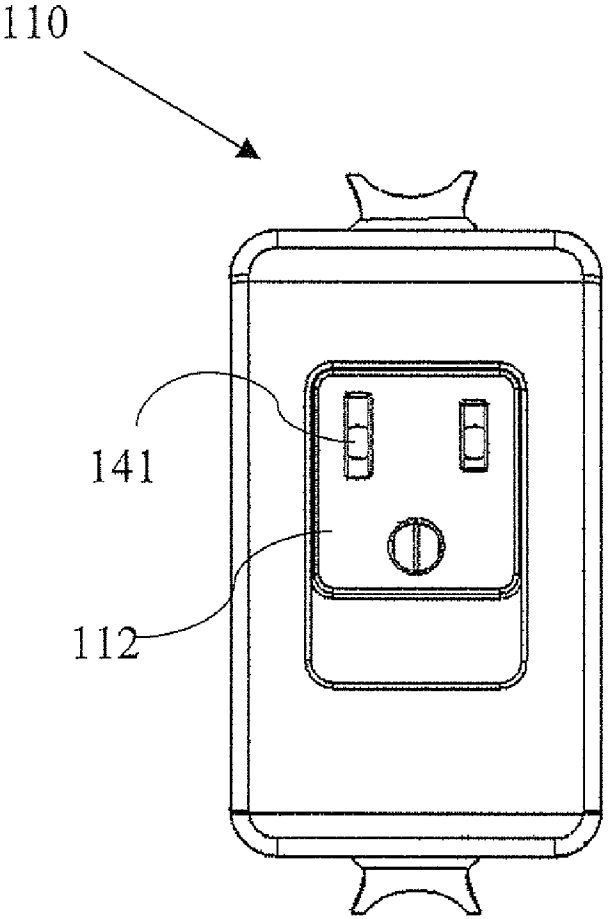
FIG. 10 is a frontal view of the second configuration of the current invention with socket cap in the initial position.
Figure 13:
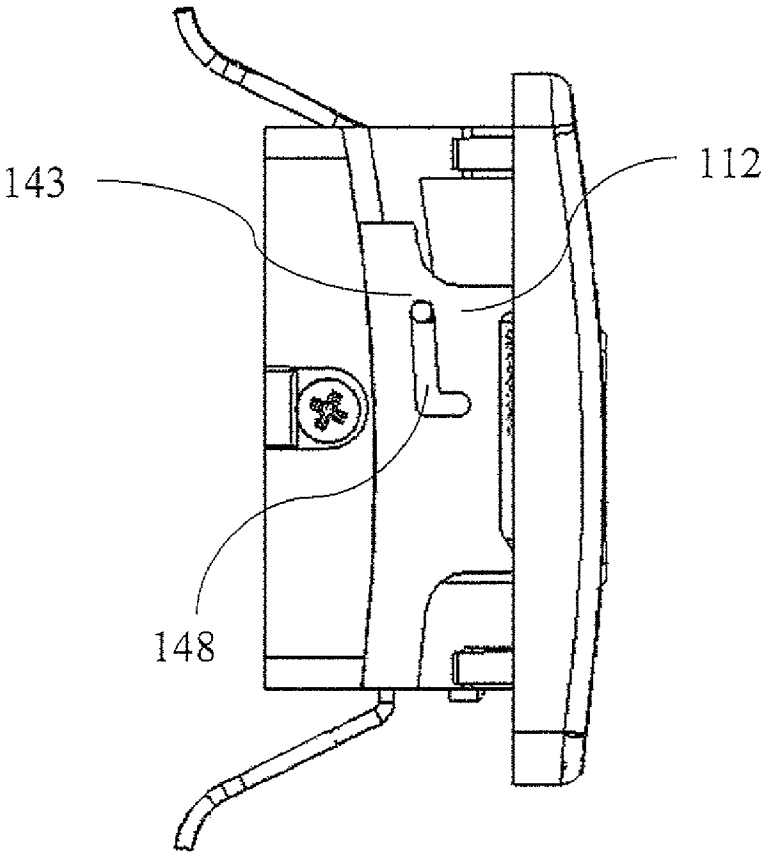
FIG. 13 is a side view of the second configuration where the socket cap is in a lowered position.
Figure 12:
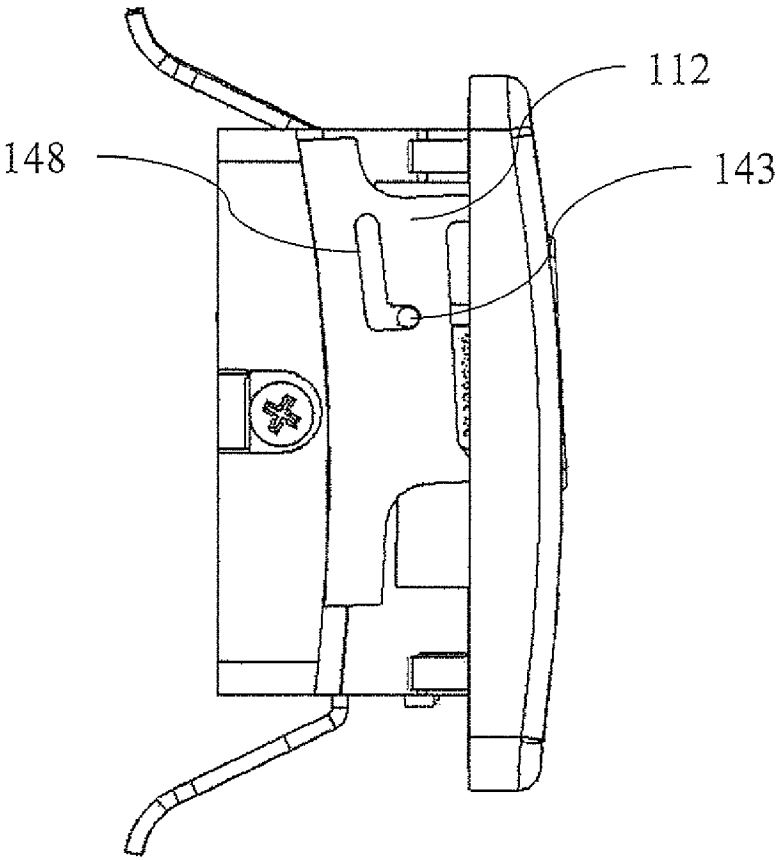
FIG. 12 is a side view of the second configuration where the socket cap is in a raised, locked position.

FIG. 9 is an exploded isometric view of the current configuration. In the preferred embodiment of the current configuration, a locking mechanism 142 locks the socket cap in an initial position (FIG. 10). The locking mechanism contains a locking pin 141 which is operationally coupled to a flange 143. When the locking mechanism is engaged, flange 143 is positioned at the tip of the 'foot' of the "L" shaped channel furthest from the 'body' of the "L" shaped channel In this position, socket cap 112 cannot move downwards. In this position, the apertures of the socket cap are disposed in front of the socket cavities. The cavities disposed behind the apertures for the live and neutral blades contain locking pins 141. The locking pins 141 are shown in FIG. 11. When a plug (not shown) is inserted into the socket cap, the blades (not shown) protrude beyond the cap into the cavities, depressing locking pins 141 therein so that flanges 143 are now positioned within the 'body' of locking channel 148, thereby allowing socket cap 112 to move downwards. After a plug has been inserted releasing the locking mechanism, downward force is applied to the plug head (not shown) until the blades (and grounding prong) laterally slot into electrical contacts 146, 147. At this point an electrical connection has been made. Socket cap 112 is operationally coupled to two springs 144 (see FIG. 11). When socket cap 112 is forced downwards by the electrical plug, the springs are extended, creating tension on the socket cap. When the blades of the electrical plug engage electrical contacts 146, 147, the blades are held in place by the electrical contacts. The pressure of the contacts on the blades together with the weight of the plug prevent the spring from pulling the socket cap back. To disengage the plug from the contacts, an upward motion is employed, excising the blades from the electrical contacts. Once free of the contacts, the plug can be removed from the socket cap with relative ease. Alternatively, in the case of an urgency or emergency, pulling the plug directly out of the socket using a conventional movement will disengage the plug from the contacts. Once blades have been disengaged from the contacts, springs 144 will contract, pulling the socket cap back into the initial position where locking mechanism 142 will reengage. FIG. 12 is a side view of the socket where socket cap 112 is locked in the initial position. Flange 143 protrudes into channel 148, preventing socket cap 112 from sliding downwards. FIG. 13 is a side view of the socket where flange 143 is at the top most end of the "L" shaped channel 148, having permitted socket cap 112 to slide downward into a lowered position where the electrical contacts are accessible.

While the invention has been described with respect to a limited number of embodiments, it will be appreciated that many variations, modifications and other applications of the invention may be made. While the invention has been described in terms of a wall socket, it will be appreciated that any type of plug receiving device, female plug receptacle, or any other prong receiving apparatus is intended. Therefore, the claimed invention as recited in the claims that follow is not limited to the embodiments described herein.

What is claimed is:

1. A safety electrical outlet comprising:

a. a socket body including at least two laterally engageable electrical contacts;

b. a socket cap including at least two apertures; said socket cap being pivotally mounted on said socket body;

c. a safety mechanism for:

i. retaining said socket cap in a first position in which said apertures are in non-alignment with said contacts; and ii. upon insertion of prongs of a plug through said apertures, releasing said socket cap to be moved reversibly into a second position in which said apertures are aligned with said electrical contacts so that said prongs engage said electrical contacts.

2. The safety electrical outlet of claim 1 further comprising:

d. a biasing element configured so as to bias said socket cap in said first position.

3. The electrical outlet of claim 2 wherein said biasing element includes a compression spring.

4. The electrical outlet of claim 1 wherein said safety mechanism includes a locking pin configured to restrict movement of said socket cap between said first position and said second position and wherein said prongs interact with said locking pin to release said socket cap when said prongs are inserted in said apertures.

5. The electrical outlet of claim 4 wherein said safety mechanism further includes a safety barrier for preventing access of a foreign body protruding through one of said apertures to one of said electrical contacts when said socket cap is in said first position, and wherein said locking pin is operationally coupled to said safety barrier so as to expose said contacts when said prongs are inserted in to said apertures.

6. The electrical outlet of claim 1 whereby said socket cap rotates in place reversibly between said first position and said second position.

7. The electrical outlet of claim 1 whereby said socket cap slides reversibly and laterally between said first position and said second position.

8. The safety electrical outlet of claim 1 wherein said laterally engageable electrical contact has a contact surface length in a range from 50% to 95% of said plug prong length.

9. A safety electrical outlet comprising:

a. a socket body including at least two laterally engageable electrical contacts;

b. a socket cap including at least two apertures; said socket cap being pivotally mounted on said socket body;

c. a safety mechanism for:

i. retaining said socket cap in a first position in which said apertures are in non-alignment with said contacts; and ii. upon receiving pressure from at least one prong of a plug, releasing said socket cap to be moved reversibly into a second position in which said apertures are aligned with said electrical contacts, so that said prongs engage said electrical contacts.

10. The electrical outlet of claim 9 wherein said safety mechanism includes a locking pin configured to restrict movement of said socket cap between said first position and said second position and wherein said at least one prong directly engages with said locking pin to release said socket cap when said at least one prong is inserted in said apertures and when pressure received on said locking pin from said at least one prong.

11. The electrical outlet of claim 10 wherein said safety mechanism further includes a safety barrier for preventing access of a foreign body protruding through one of said apertures to one of said electrical contacts when said socket cap is in said first position, and wherein said locking pin is operationally coupled to said safety barrier so as to expose said contacts when pressure is received on said locking pin directly from said at least one prong.

12. The electrical outlet of claim 9 wherein said safety mechanism includes two locking pins configured to restrict movement of said socket cap between said first position and said second position and wherein two of said prongs of a plug directly engage with said locking pins to release said socket cap when said two prongs are inserted in said apertures and when pressure is received on said locking pins directly from said two prongs.

13. The electrical outlet of claim 12 wherein said safety mechanism further includes two safety barriers for preventing access of a foreign body protruding through one of said apertures to one of said electrical contacts when said socket cap is in said first position, and wherein said locking pins are operationally coupled to said safety barriers so as to expose said contacts when pressure is received on said locking pins directly from said two prongs.

14. The safety electrical outlet of claim 9 wherein said laterally engageable electrical contact has a contact surface length in a range from 50% to 95% of said plug prong length.

* * * * *